US008122630B2

(12) United States Patent
Dicke

(10) Patent No.: US 8,122,630 B2
(45) Date of Patent: Feb. 28, 2012

(54) RIB SUPPORT OF FOLDED MATERIAL

(75) Inventor: Grant Donald Dicke, Downers Grove, IL (US); Vera Dicke, legal representative, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 419 days.

(21) Appl. No.: 12/459,496

(22) Filed: Jul. 2, 2009

(65) Prior Publication Data

US 2011/0000112 A1 Jan. 6, 2011

(51) Int. Cl.
*G09F 17/00* (2006.01)

(52) U.S. Cl. ..... 40/612; 40/603; 40/610; 40/639; 160/390

(58) Field of Classification Search ..... 40/604, 40/539, 124.09, 610, 612, 601; 160/390, 160/386, 387; 2/247–254; 112/470.09
See application file for complete search history.

(56) References Cited

U.S. PATENT DOCUMENTS

| | | | | | |
|---|---|---|---|---|---|
| 1,390,736 | A | | 9/1921 | Wadsworth | |
| 1,485,846 | A | | 3/1924 | Griffin | |
| 1,699,735 | A | | 1/1929 | Dabrohua et al. | |
| 1,873,178 | A | | 8/1932 | Bernstein | |
| 2,160,426 | A | | 5/1939 | Archer | |
| 2,242,736 | A | * | 5/1941 | Wilder et al. | 40/672 |
| 2,323,653 | A | * | 7/1943 | Fowler, Jr. | 40/672 |
| 2,484,096 | A | * | 10/1949 | Kay | 244/153 R |
| 3,143,817 | A | | 8/1964 | Paulson | |
| 3,200,786 | A | | 8/1965 | Swezy et al. | |
| 3,450,378 | A | | 6/1969 | Cucka | |
| 3,526,200 | A | | 9/1970 | Doyle | |
| 3,722,841 | A | | 3/1973 | Ciolfi | |
| 3,825,214 | A | | 7/1974 | Ciolfi | |
| 3,899,843 | A | * | 8/1975 | Doyle et al. | 40/602 |
| 4,015,802 | A | | 4/1977 | Heredia | |
| 4,015,902 | A | * | 4/1977 | Betensky | 355/60 |
| 4,426,800 | A | | 1/1984 | Brown | |
| 4,481,729 | A | | 11/1984 | Weiller | |
| 4,490,934 | A | | 1/1985 | Knapp | |
| 4,507,887 | A | | 4/1985 | Seely | |
| 4,592,158 | A | | 6/1986 | Seely | |
| 4,798,356 | A | | 1/1989 | Alonso | |
| 4,888,894 | A | | 12/1989 | Brown, Jr. | |

(Continued)

FOREIGN PATENT DOCUMENTS

| | | |
|---|---|---|
| WO | WO 91/10986 | 7/1991 |

*Primary Examiner* — Casandra Davis
(74) *Attorney, Agent, or Firm* — Olson & Cepuritis, Ltd.

(57) ABSTRACT

A rib-engaging support is made from a unitary web having four panels, including two inner panels and two outer panels, with each panel having the shape of an isosceles trapezoid. Each panel includes a base side and a top side parallel to each other, and a pair of equal sides extending between the base side and the top side. The inner panels have a smaller size and are joined together at their bases. The outer panels have a larger size, with their top sides joined to the top sides of respective inner panels along respective fold lines. The web is folded such that the inner panels are folded one on top of the other and the outer panels are folded one on top of the other, with the inner panels on top of the outer panels. A rib-receiving pocket is formed between the inner panels and the outer panels.

25 Claims, 10 Drawing Sheets

U.S. PATENT DOCUMENTS

| | | | |
|---|---|---|---|
| 5,090,143 | A | 2/1992 | Schier et al. |
| 5,446,984 | A | 9/1995 | Kulp et al. |
| 5,540,007 | A | 7/1996 | Kulp et al. |
| 5,979,847 | A | 11/1999 | Williams et al. |
| 6,003,827 | A | 12/1999 | Kulp et al. |
| 6,047,941 | A | 4/2000 | Kulp et al. |
| 6,053,658 | A | 4/2000 | Gibson, Jr. |
| 6,056,250 | A | 5/2000 | Hillstrom et al. |

* cited by examiner

Fig. 12
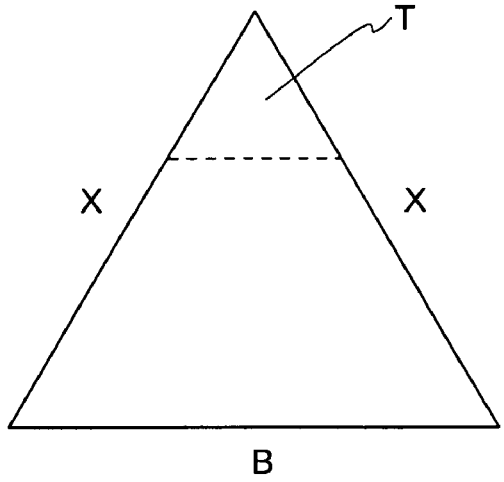
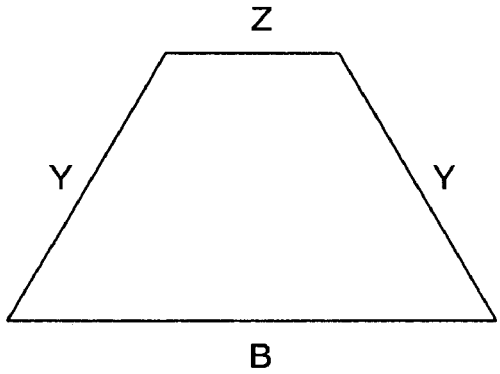
Fig. 13
Fig. 3
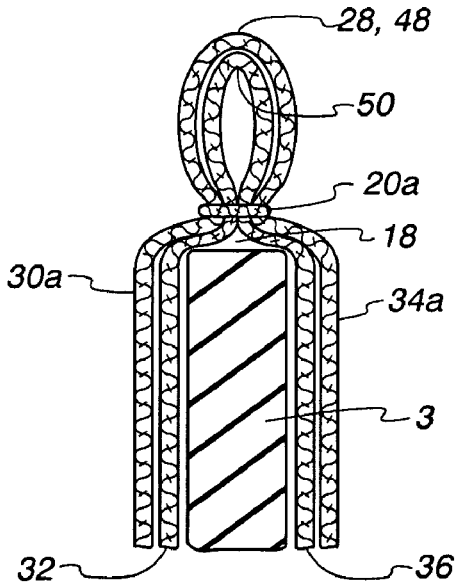

RIB SUPPORT OF FOLDED MATERIAL

FIELD OF THE INVENTION

The present invention pertains to support structures for receiving rib members and in particular to support structures used with flexible signs.

BACKGROUND OF THE INVENTION

Roadside construction projects must oftentimes be carried out without stopping roadway traffic. Accordingly, measures are required to maintain safety in the work environment. Temporary warning signs are becoming increasingly popular since the geographic configuration of a work site frequently changes before the work is finished. Also, with the advent of more powerful, complex equipment, roadway repairs and roadside work projects can be completed within a relatively short time, such that erection of permanent warning signs would not be practical.

One class of temporary warning signs includes sign panels made of flexible material, which are maintained in a taut, planar position by backing members extending across the sign panel. These backing members frequently comprise ribs of fiberglass or aluminum material. It has become popular to arrange the sign panel so that it can be quickly and easily detached from the supporting ribs and rolled up for compact storage. Thus, the need arises for releasably securing the rib members to the flexible sign panel.

Initially, pockets for receiving the ends of supporting ribs were formed by joining relatively small pieces of fabric to the corners of the flexible sign panels, so as to form a rib-receiving pocket between the fabric and the sign panel. Roadway warning signs are employed out of doors and are thereby subjected to wind gusts and traffic induced wind bursts which expose the flexible sign panel to substantial amounts of strain, particularly where rib supports are attached to the sign panel. Accordingly, with static and vibratory wind loadings applied to the sign panel, the ends of the supporting ribs were found to wear through the pocket material, requiring substantial repairs to be made to the sign assembly. In time, steps were taken to provide more secure attachment of supporting ribs to portions, usually outside corners, of the sign panel. For example, fabric pockets have been employed in U.S. Pat. Nos. 3,899,843 and 3,526,200, while resilient straps have been proposed in U.S. Pat. No. 4,592,158. Rigid panel pockets have also been proposed in U.S. Pat. Nos. 4,426,800 and 4,490,934. Despite these advancements, improvements in rib supports are still being sought.

SUMMARY OF THE INVENTION

The present invention provides a novel and improved rib-engaging support that minimizes the disadvantages associated with the prior art arrangements and provides advantages in construction, mode of operation and use. One embodiment of the rib-engaging support is made from a unitary web that includes a serial succession of four panels, including two inner panels and two outer panels. Each panel has the shape of an isosceles trapezoid, with a base side and a top side parallel to each other, and with a pair of equal sides extending between the base side and the top side. The inner panels have the same, first size and are joined together at their bases. The outer panels have a second larger size and their top sides are joined to the top sides of respective inner panels. When the web is folded, the inner panels are folded one on top of the other and the outer panels are folded one on top of the other, with the inner panels on top of the outer panels. A rib-receiving pocket is formed between the inner panels and the outer panels. Marginal edge portions of the panels are provided for securement to a sign panel using adhesive or stitching techniques. The rib-receiving pocket is preferably formed by stitching the panels together. In use, the rib-receiving pocket has a line of stitching between the free end of the support rib and an edge of the rib-engaging support that includes nested folds at the places where the inner and outer panels are joined together.

In another embodiment, the present invention provides a flexible warning sign comprising a flexible message panel capable of assuming a substantially flat configuration for displaying a message, and at least one support rib removably joined to the flexible message panel. Also included is a rib-engaging support is made from a unitary web that includes a serial succession of four panels, including two inner panels and two outer panels. Each panel has the shape of an isosceles trapezoid, with a base side and a top side parallel to each other, and with a pair of equal sides extending between the base side and the top side. The inner panels have the same, first size and are joined together at their bases. The outer panels have a second larger size and their top sides are joined to the top sides of respective inner panels. When the web is folded, the inner panels are folded one on top of the other and the outer panels are folded one on top of the other, with the inner panels on top of the outer panels. A rib-receiving pocket is formed between the inner panels and the outer panels for receiving an end of the support rib. Marginal edge portions of the panels are provided for securement to a sign panel using adhesive or stitching techniques. The rib-receiving pocket is preferably formed by stitching the panels together. In use, the rib-receiving pocket has a line of stitching between the free end of the support rib and an edge of the rib-engaging support that includes nested folds at the places where the inner and outer panels are joined together.

BRIEF DESCRIPTION OF THE DRAWINGS

In the drawings:

FIG. 3 is a fragmentary cross-sectional view taken along the line 2-2 of FIG. 1;

FIG. 12 is a schematic diagram of an isosceles triangle;

FIG. 13 is a schematic diagram of an isosceles trapezoid;

DESCRIPTION OF THE PREFERRED EMBODIMENTS

Figure 1:
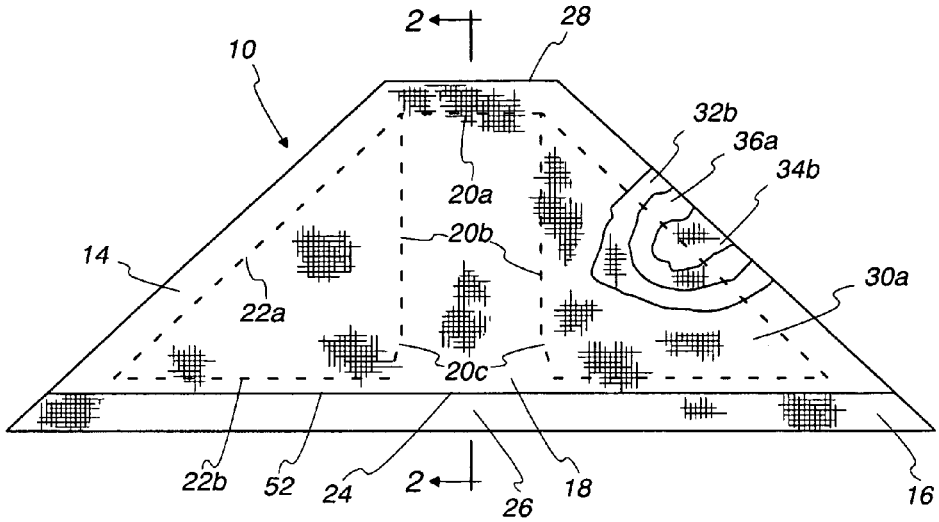
FIG. 1 is a schematic elevational view of a rib-engaging support.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments. For use of description, a rib-engaging support embodying the present invention is described herein below in its usual assembled position as shown in the accompanying drawings, and terms such as upper, lower, top, base, horizontal, longitudinal, etc., may be used herein with reference to this usual position. However, the rib-engaging support may be manufactured, transported, sold or used in orientations other than that described and shown herein.

Figure 14:
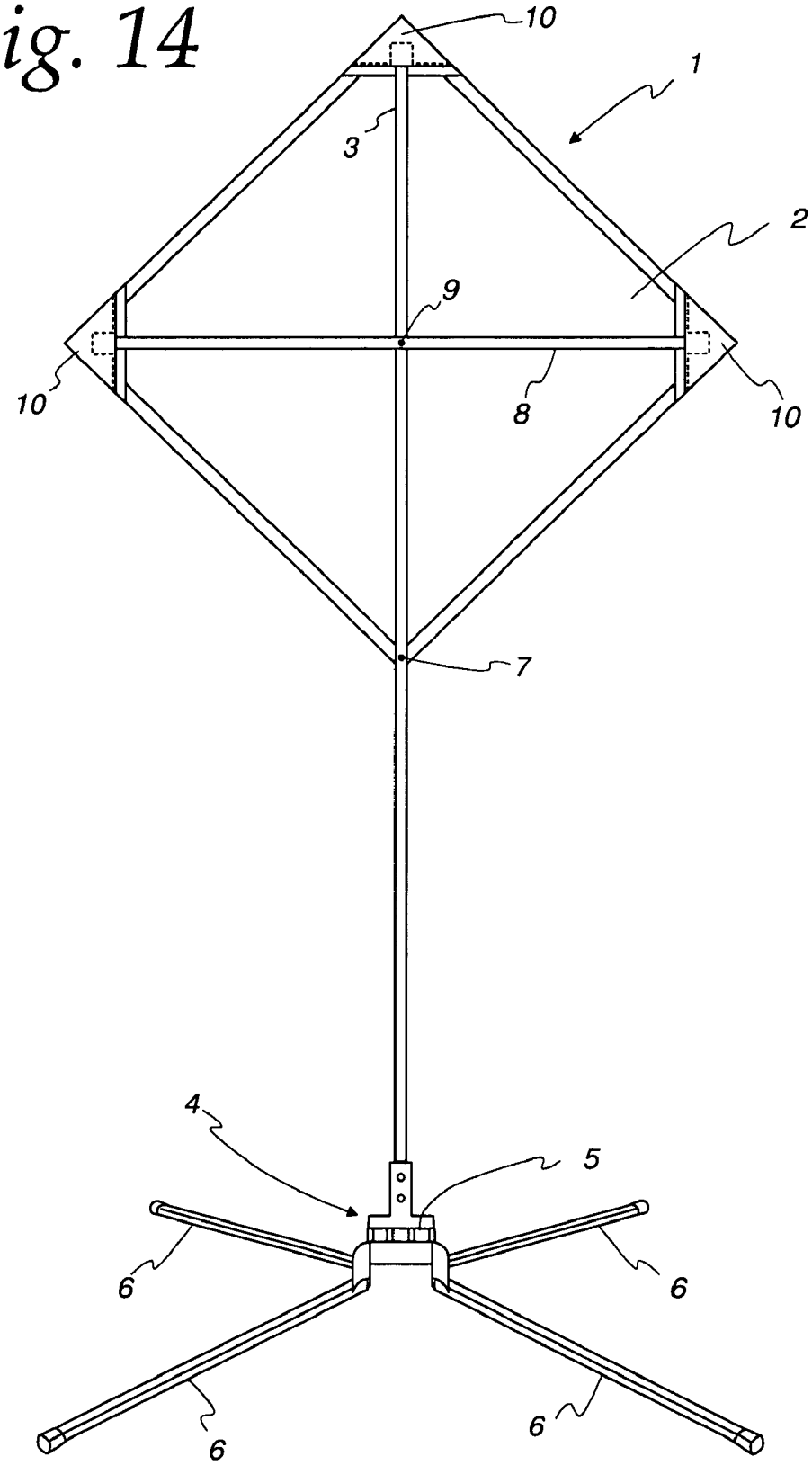
FIG. 14 is a schematic diagram of a sign assembly with rib-engaging supports.

Turning now to the Figures, and initially to FIG. 14, a lightweight sign assembly is generally indicated at 1. The sign stand assembly is particularly suited for temporary, roadside work to warn oncoming motorists that they are entering a work zone or an area that otherwise requires their careful attention. Sign assembly 1 includes a sign panel 2 made of flexible fabric, preferably with a reflective coating and bearing a message on one of its faces. When used in a roadside work environment, the sign panel 2 must be maintained in a relatively taut condition, in order to adequately display warning messages to oncoming motorists. Accordingly, a support arrangement is provided for engaging the sign panel 2 at its corners with stretching members.

In the illustrated embodiment, two rib support members are employed, and may be made of a flexible material such as fiberglass resin or aluminum, or otherwise constructed so as to be able to bend for insertion into corner pocket support members. In the illustrated embodiment, a vertical support rib 3 extends to the top of sign panel 2. The sign assembly I is supported from below by a ground-engaging base generally indicated at 4. Included in the base is a spring dampening assembly 5 and ground-engaging legs 6. In the illustrated embodiment, vertical support rib 3 extends to base 4 thus, also serving as an upright support member for the sign panel. If desired, a separate upright support member can be provided to extend from base 4, connecting to vertical rib 3 with a rib-receiving connection, as may be desired. In use, when placed out of doors, sign panel 2 acts as a sail capturing static wind loading and wind bursts which are transmitted to base 4. Spring-loaded dampener 5 absorbs the wind loading, preventing dislodgment of legs 6 from their contact with the ground.

In the illustrated embodiment, sign panel 2 is secured at its bottom portion to rib 3 by fastener 7, which preferably takes a conventional form of a rivet or the like. A horizontal support rib 8 is secured to vertical rib 3 by rivet or other suitable fastener 9. Rib-engaging supports 10 are located at the side and top corners of the sign panel 2. Preferably, the rib-engaging supports 10 are secured to sign panel 2 with stitching but can also be secured with adhesive, welding or mechanical fasteners. In the illustrated embodiment of FIG. 14, rib-engaging supports 10 act as corner pockets for receiving the ends of horizontal rib 8 and the top end of vertical rib 3.

During erection of the sign assembly 1, horizontal rib 8 is flexed in a horizontal plane so as to shorten the horizontal distance to rib-engaging support 10. The rib is then inserted in the corner pocket, in a manner to be described herein, and is allowed to resume its relaxed position illustrated in FIG. 14. The upper end of rib 3 is also flexed in a similar manner for engagement with the upper rib-engaging support 10.

When sign assembly I is no longer required, it is easily disassembled and rolled up for compact storage. Rib 3 is flexed in a vertical plane so as to allow the disengagement of its upper end from the upper rib-engaging support 10. The horizontal rib 8 is then flexed in a horizontal plane to allow disengagement with the rib-engaging supports 10 located at the sides of sign panel 2. Rib 8 is then rotated 90° so as to overlay vertical support rib 3 and sign panel 2 is then rolled about the collapsed ribs. Support rib 3 is disengaged from base 4 and the two components are moved to a storage location. Thus, sign assembly 1 can be quickly and easily erected and taken down on short notice, making it suitable for short term deployment.

Figure 2:
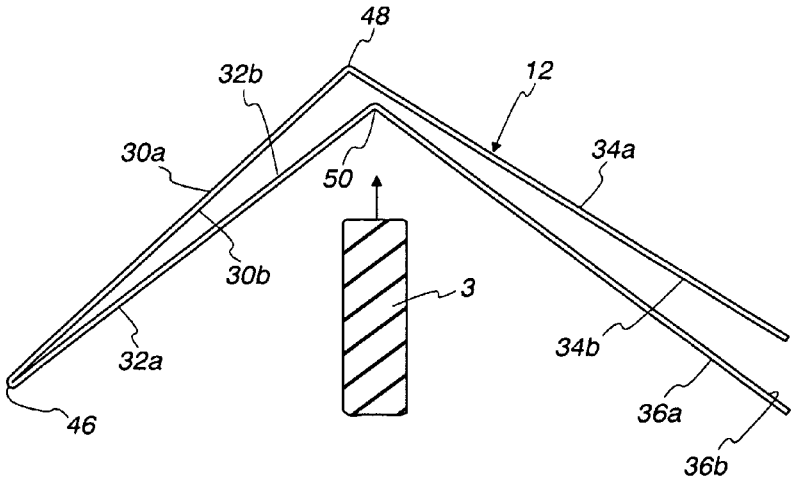
FIG. 2 is a cross-sectional view taken along the line 2-2 of FIG. 1.

Turning now to FIGS. 1 and 2, a rib-engaging support 10 is shown constructed from foldable web material, such as a woven fabric or a sheet of solid but foldable material. As will be seen herein, the rib-engaging support 10 is preferably made from a single integral web which is folded and stitched to provide a number of desirable features.

FIG. 2 is a schematic diagrammatic representation of a cross section of rib-engaging support 10, taken along the line 2-2 of FIG. 1. In FIG. 2, the stitching of FIG. 1 is removed and the folded layers are opened for illustrative purposes. As shown in FIG. 2, the rib-engaging support 10 of FIG. 1 is constructed from a single integral web 12 which will be described in detail herein with reference to FIG. 4. Preferably, rib-engaging support 10 is completely constructed with folding and stitching in the manner described herein.

Referring again to FIG. 1, rib-engaging support 10 is made of four web layers, two of which, 30*a* and 36*a*, are visible in FIG. 1. The four layers are stitched together along lines 20*a*-20*c*, 22*a* and 22*b* with lines 20*a*-20*c* forming the rib-receiving pocket 18 having an opening 24 for receiving one end of a support rib, preferably with a relatively close tolerance fit. As can be seen in FIG. 1, opening 24 of rib pocket 18 has an enlarged mouth due to angled or tapered stitching segments 20*c*. The resulting funnel-shaped opening helps guide the rib for its initial entry into pocket 18. Stitching segments 20*c* in effect remove a right angle corner thus further reducing stress imparted to the stitching by the rib. The remaining stitching 22*a*, 22*b* extends generally parallel to the outer perimeter of the folded inner panels (30, 32—see FIG. 4) collectively indicated at 14. As can be seen in FIG. 1, the folded outer panels (34, 36—see FIG. 4) collectively indicated at 16 are of a somewhat larger size so as to form an exposed lip or threshold 26 to aid in orienting the rib end for insertion into pocket 18. With reference to FIG. 3, one end of rib 3 is inserted in pocket 18 and is encased by two inter-nested, unbroken, continuous fabric layers, forming two overlaying layers on either side of rib 3.

Referring again to FIG. 3, it can be seen that the present invention provides a cushion of accumulated material at the end of rib 3. The accumulated material preferably comprises the nested groups of material extending beyond stitching line 20*a* and which include the fold lines 48, 50. As can be seen in FIG. 3, this accumulated material provides a collapsible cushion which protects stitching line 20*a* and the fabric in the vicinity of that stitching, particularly, the end of the rib-receiving pocket 18. With reference to FIG. 14, for example, the lateral or horizontal rib device 8 is inserted between opposed rib-engaging supports 10. It has been found convenient to insert one end of the rib at a time, while pressing the rib against the ground. This allows an operator to apply a bowing force to the rib member, allowing insertion of the remaining free end of the rib into the second rib-engaging support. As will be appreciated by those skilled in the art, ribs made of composite fiberglass material have a relatively large spring constant and can develop a considerable amount of force when bent or deflected in the manner required for insertion in a pair of opposing rib-engaging supports. Prior art designs in which the rib and sign panel are forced directly into the ground, without benefit of a cushion at the rib end concentrates forces in the rib-engaging support on both sides of the pocket stitching (see reference number 91 in FIG. 6). With the present invention, edge surface 28 of the rib-engaging support pocket (see the top of FIGS. 1 and 3) prevents not only poke-through on the inside of the rib-receiving pocket but also prevents abrasion and wearing away of the rib-engaging support on the outside of the rib-receiving pocket.

As will now be described in further detail, it is generally preferred that rib-engaging support 10 have the shape of a truncated isosceles triangle or isosceles trapezoid, although other shapes are also contemplated by the present invention. With reference to FIG. 12, a diagram of an isosceles triangle is shown having a base B and equal sides X. As is known, sides X have equal lengths, and form equal but opposite angles with base B. In other terms, the sides X form congruent angles with base B. A tip of the triangle is indicated at T and is formed by a broken line generally parallel to base B. If the tip I of the triangle is removed, the figure illustrated in FIG. 13 results. As is known, the shape illustrated in FIG. 13 is referred to an isosceles trapezoid, which is a quadrilateral with a line of symmetry bisecting one pair of opposite sides, herein the base B and top Z. making it automatically a trapezoid. The two opposite sides, base B and top Z are parallel to one another and the two remaining sides Y are of equal length. The diagonals of the isosceles trapezoid of FIG. 13 are of equal length. The base angles formed between sides Y and base B are congruent. With reference to FIG. 1, the outer periphery of the illustrated embodiment of rib-engaging support 10 takes the shape of an isosceles trapezoid. As will be seen herein, rib-engaging support 10 is preferably formed by folding an integral web having a serial array of four consecutive panels, each having the shape of an isosceles trapezoid.

Figure 4:
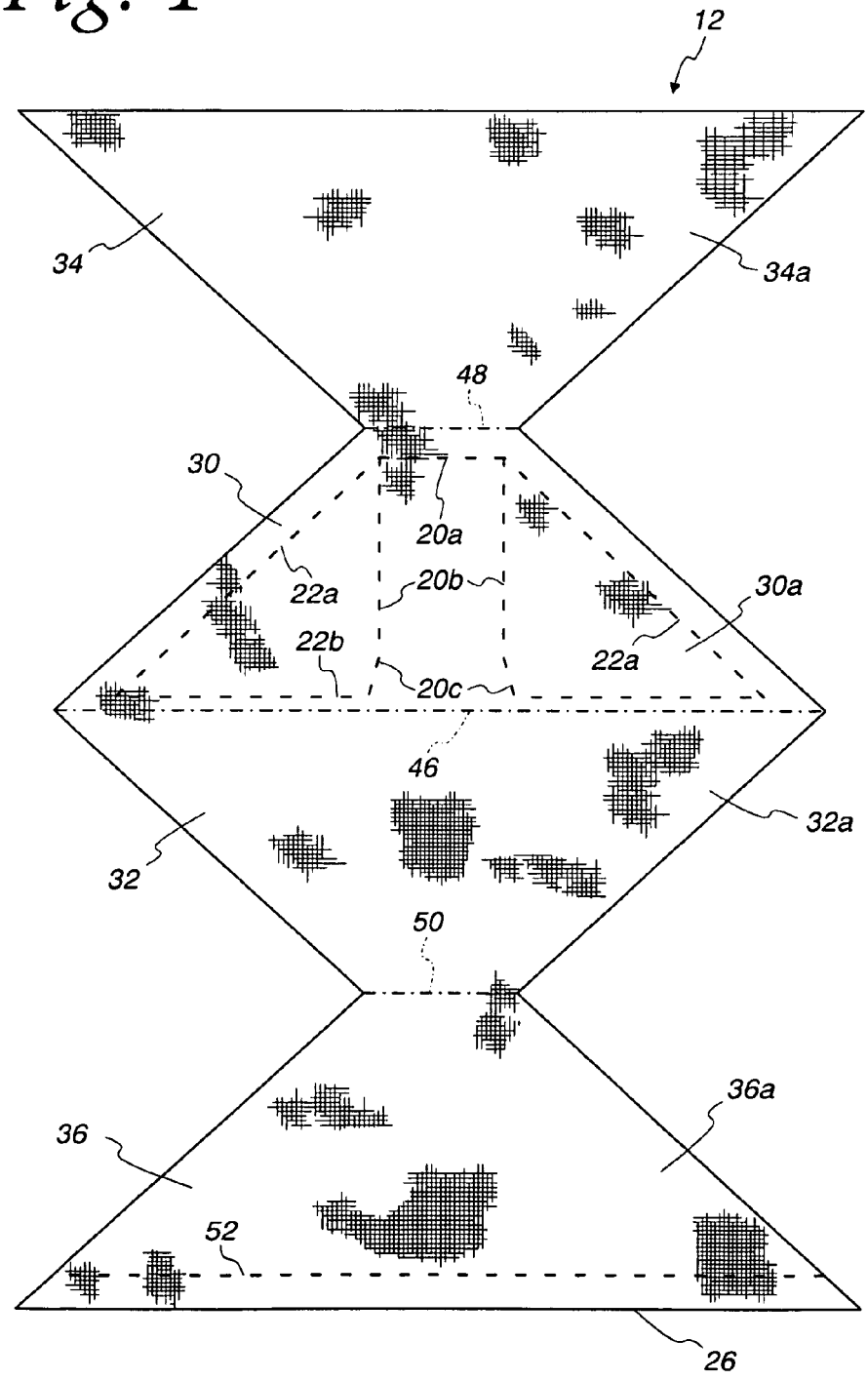
FIG. 4 is a schematic plan view of a web from which the rib-engaging support is constructed.

With reference to FIG. 4, blank 12 is preferably formed from a single integral web cut along ten sides to form the shape illustrated. Included in blank 12 is a serial succession of four panels including two inner panels 30, 32 and two outer panels 34,36, each panel having the shape of an isosceles trapezoid, with a base side and a top side parallel to each other, and with a pair of equal sides extending between the base side and the top side. The inner panels 30, 32 have substantially the same size and are joined together at their bases along fold line 46. The outer panels 34, 36 have a second larger size (that is larger than the size of the inner panels 30, 32).

As will be seen with reference to FIG. 4, inner and outer panels 30-36 preferably form portions of a continuous integral fabric blank illustrated in FIG. 4. The fabric blank has two opposed major surfaces with the major surface visible in FIG. 4 being designated by a suffix "a" referred to as the top side or top surface. Thus, the top sides of outer panels 34, 36 and inner panels 30, 32 have upper surfaces designated by the suffix "a." Accordingly, the top sides of inner panels 30, 32 are identified in FIG. 4 as 30*a*, 32*a* and the top sides of outer panels 34, 36 are identified by the reference numbers 34*a*, 36. The reverse or bottom sides of these surfaces would be identified by the suffix "b." Accordingly, the opposite surfaces of panels 30, 32 are identified as 30*b*, 32*b* and the opposite sides of outer panels 34, 36 are identified as 34*b*, 36*b*. With reference to FIG. 1 portions of the bottom surfaces 32*b*, 34*b* are visible and appear in conjunction with the top sides 30*a*, 36*a* to the folding of the fabric blank. The opposite top and bottom surfaces of the fabric panels are identified in FIG. 2.

The top sides of the outer panels 34, 36 are joined to the top sides of respective inner panels 30, 32 along fold lines 48, 50. In FIG. 4, the outline of stitching 20, 22 is also shown for illustrative purposes. Outer panel 36 is shown with a construction line 52 which, with reference to FIG. 1, indicates the exposure of threshold 26.

Figure 5:
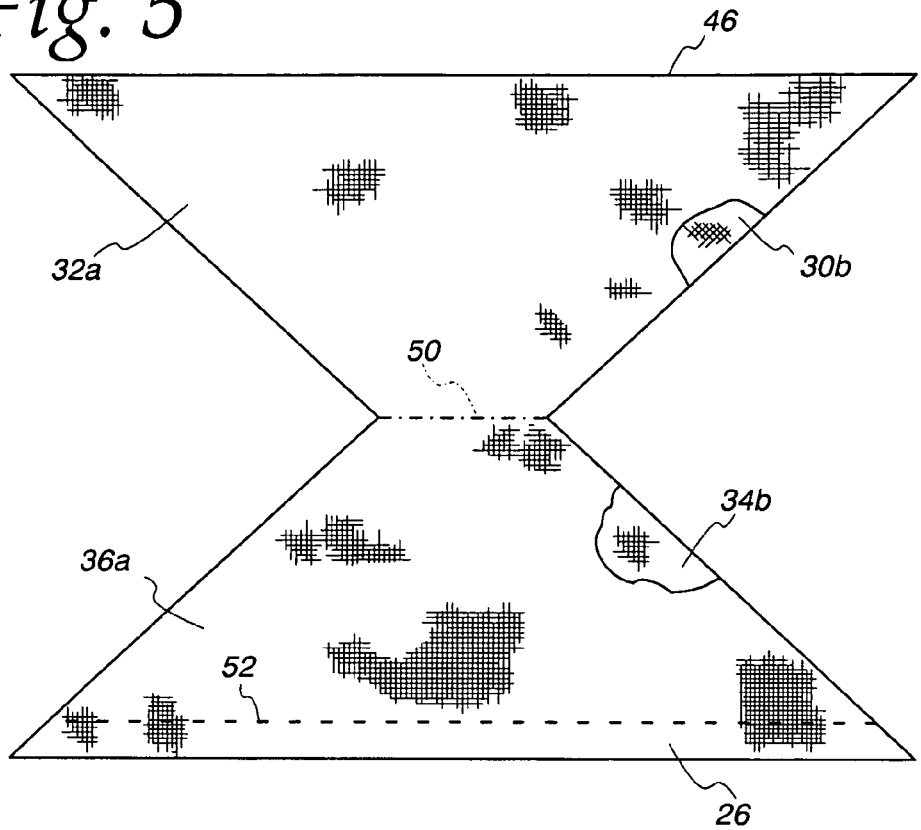
FIG. 5 shows the rib-engaging support at an intermediate stage of construction.

With reference to FIG. 4, rib-engaging support 10 is constructed by folding blank 12 first along fold line 46 so as to overlay the two half portions of blank 12 on top of one another, in the manner illustrated in FIG. 5. Thereafter, the resulting intermediate structure is folded about fold lines 50, 48 so as to bring the four panels in overlying relationship.

The resulting folded construction is shown opened up or expanded in FIG. 2 for illustrative purposes. As mentioned, each of the four panels has opposite top and bottom sides. With brief reference to FIG. 4, the top sides visible in FIG. 4 have the reference designation a while the reverse sides (not visible in FIG. 4) have the reference designation b. As can be seen in FIG. 1, the size of the inner panels such as the inner panel 30, has the same shape but is smaller than the outer panels such as outer panel 36. In the fully assembled arrangement of the rib-receiving support 10 as seen in FIG. 1, only panel faces 30*a* and 36*a* are visible. As indicated in FIG. 2, the inner panels 30, 32 are folded one against the other and the outer panels 34, 36 are also folded against each other. When fully constructed, the inner panels 30, 32 are folded to lay on top of the outer panels 34, 36 whose free ends are located at the bottom edge of the rib-engaging support visible in FIG. 1. If desired, the bottom free edges of the outer panels in FIG. 1 can be sewn together before being joined to the sign panel. However, in the preferred embodiment, the rib-engaging support 10 is secured to the sign panel by stitching along the outer periphery of the rib-engaging support. With reference to FIG. 1, a peripheral border is provided for this purpose, and the threshold 26 is, in the preferred embodiment, also secured to the sign panel by stitching, and thus is relied upon to secure the free edge. In the preferred construction, rib-engaging supports 10 are overlaid on the sign panel, (such as the sign panel 2 of FIG. 14) and are secured to the sign panel using conventional techniques. In the preferred embodiment, the outer border portions of rib-engaging supports 10 are stitched directly to the sign panel, but may also be secured with adhesives, mechanical fasteners or thermal welding, for example. Thus, if the rib-engaging support is made from a sheet of plastic material, the stitching may be replaced with a welded joinder. These techniques are also possible if a layer of fabric or other material is coated with a weldable coating.

Figure 6:
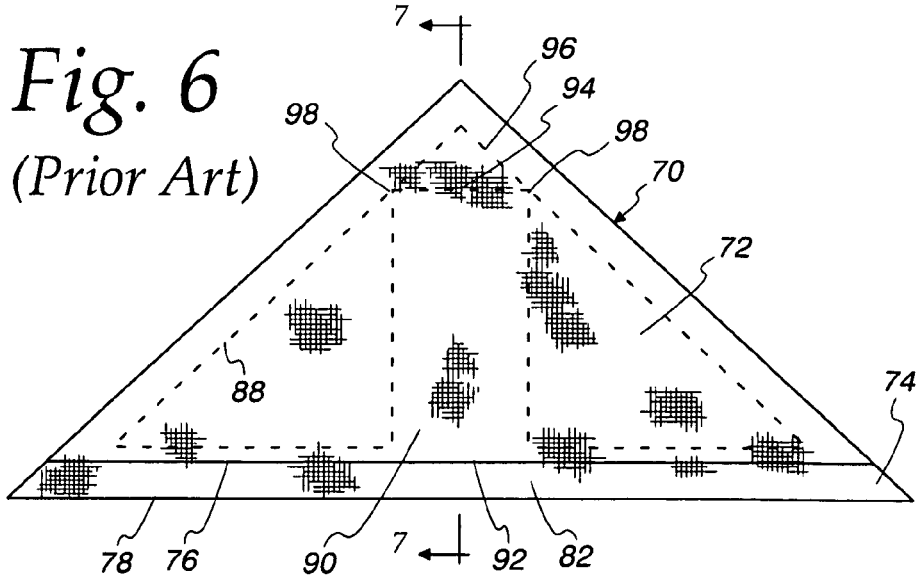
Fig. 6 (Prior Art)
FIG. 6 is a schematic elevational view of a prior art support.
Figure 7:
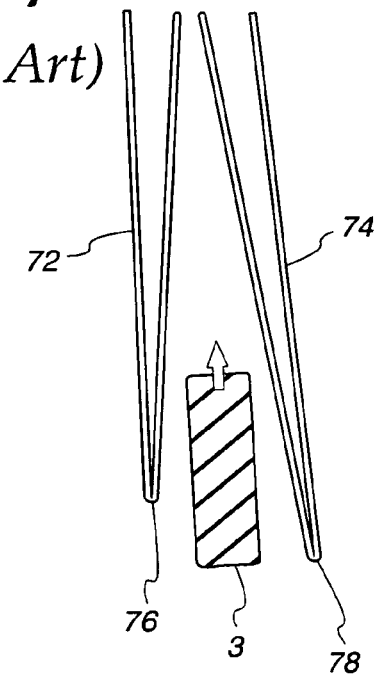
Fig. 7 (Prior Art)
FIG. 7 is an exploded cross-sectional view taken along the line 7-7 of FIG. 6.
Figure 8:
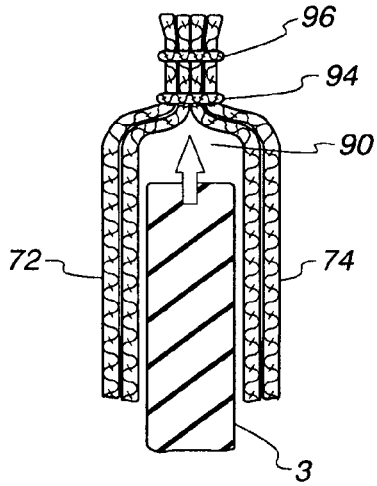
Fig. 8 (Prior Art)
FIG. 8 is a fragmentary cross-sectional view taken along the line 7-7 of FIG. 6.
Figure 9:
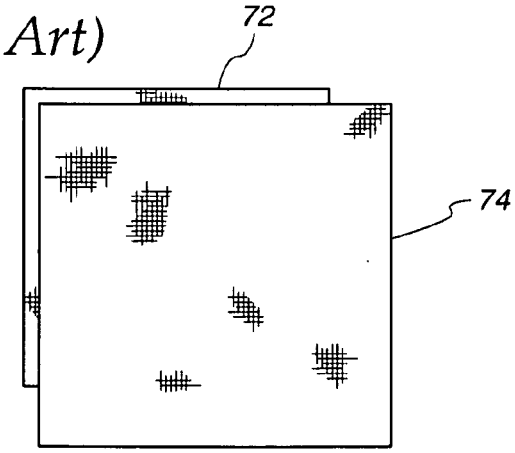
Fig. 9 (Prior Art)
FIG. 9 shows fabric panels from which the support of FIG. 6 is constructed.
Figure 10:
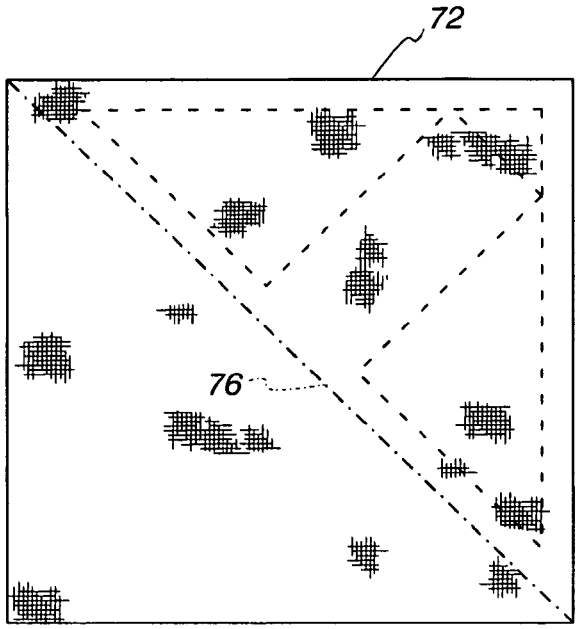
Fig. 10 (Prior Art)
FIG. 10 shows one of the fabric panels.
Figure 11:
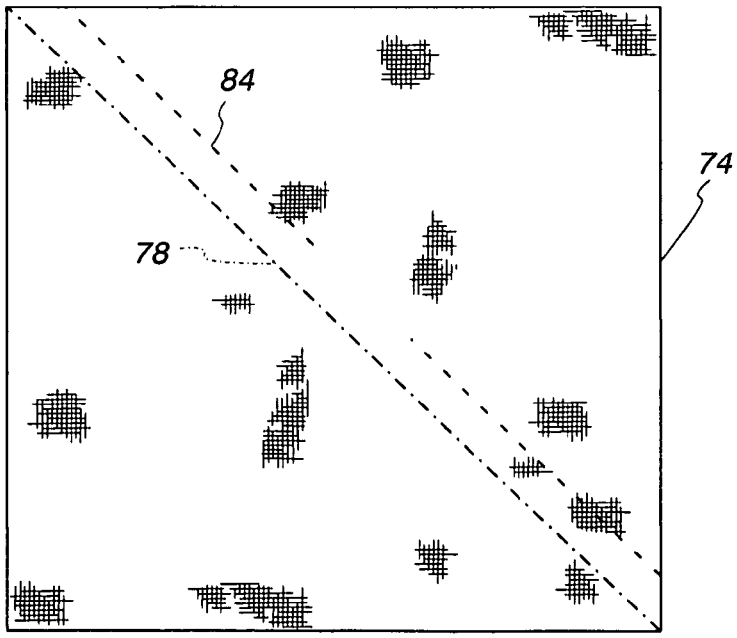
Fig. 11 (Prior Art)
FIG. 11 shows the other fabric panel.

Referring to FIGS. 6-11, a prior art rib support is generally indicated at 70. Support 70 is made from two fabric pieces as illustrated in FIG. 9, a smaller piece 72 and a larger piece 74. As indicated in FIG. 7, the fabric pieces 72, 74 are each folded in an upwardly opening V-shape with the four free ends of FIG. 7 located at the top of the support of FIG. 6. With reference to FIGS. 10 and 11, fabric pieces 72, 74 are folded along respective diagonal fold lines 76, 78 to assume the forms shown in FIG. 7. As can be seen for example in FIG. 9, the panel 72 has generally the same shape as panel 74, but is smaller in size. When folded and laid together as indicated in FIG. 6, a bottom edge portion 82 of folded piece 74 is exposed. The line of exposure is indicated at 84 in FIG. 11. When fully constructed, the fold line 76 of piece 72 is overlaid on construction line 84 in FIG. 11.

The pieces 72, 74 are secured together with stitching 88 so as to form a rib-receiving pocket 90 having an opening 92. The outline of stitching 88 is shown in FIG. 10 for illustrative purposes. Stitching 88 secures four layers of fabric together, with two layers of fabric piece 72 overlaid on top of two folded layers of fabric piece 74. With reference again to FIG. 6, the top of pocket 90 is formed by stitching 94 and is backed up by stitching 96 in case stitching 94 should fail. As can be seen in the cross-sectional view of FIG. 8, the upper ends of folded fabric pieces 72, 74 are located at the upper end of FIG. 8. Support rib 3 disposed in pocket 90 is restrained in an upward direction only by stitching 94. Over time, when subjected to static and dynamic wind loadings, rib 3 exerts substantial forces on pocket 90, thereby occasioning failure of stitching 94. With reference to FIG. 6, substantial point loadings are exerted on the corners 98 of the stitching. With the integrity of stitching 94 compromised, forces are transferred to stitching 96 with concentrated point loadings. The result is failure of the sign assembly requiring the sign panel with attached supports to be removed for repair or replacement.

As can be seen with reference to FIGS. 2 and 3, the present invention offers the significant improvement of having stitching 20 backed up by continuous inter-nested folded portions of material with fold lines 48, 50 extending in the same direction as the upper end of support rib 3 (i.e. parallel to stitch line 20*a*), thereby eliminating point loading on the panel fabric. As mentioned, stitching 20*a*-20*c* extends through four layers of web material and defines the upper end (as well as the sides) of the rib-receiving pocket. In the unlikely event that stitching 20*a* should fail, the free end of rib 3 will shift within the rib-engaging support, with the upper blunt end of support rib 3 pressing against fold line 50, which is in intimate contact with fold line 48. Thus, the end of support rib 3 is supported by continuous unbroken web portions adjacent fold lines 48, 50. As can be seen for example in FIG. 4, these fold lines are disposed within the interior of blank 12. With reference to FIG. 1, stitching 22*a*, 22*b* secures the four layers of fabric together, throughout their peripheral extent. Accordingly, pressure on fold line 50 caused by the end of support rib 3 is transferred to fold line 48. This force is in turn distributed throughout the four panels of the integral blank shown in FIG. 4 in order to minimize local stress at the point of contact between the support rib and the rib-engaging support, thus maximizing the retention of the rib within support 10. Thus, the length of fold lines 48, 50 is directly related to the width of support rib 3. Should a support rib of greater width be desired, blank 12 can be readily adjusted to increase the length of fold lines 48, 50, preferably by increasing the width of blank 12 throughout.

Figure 15:
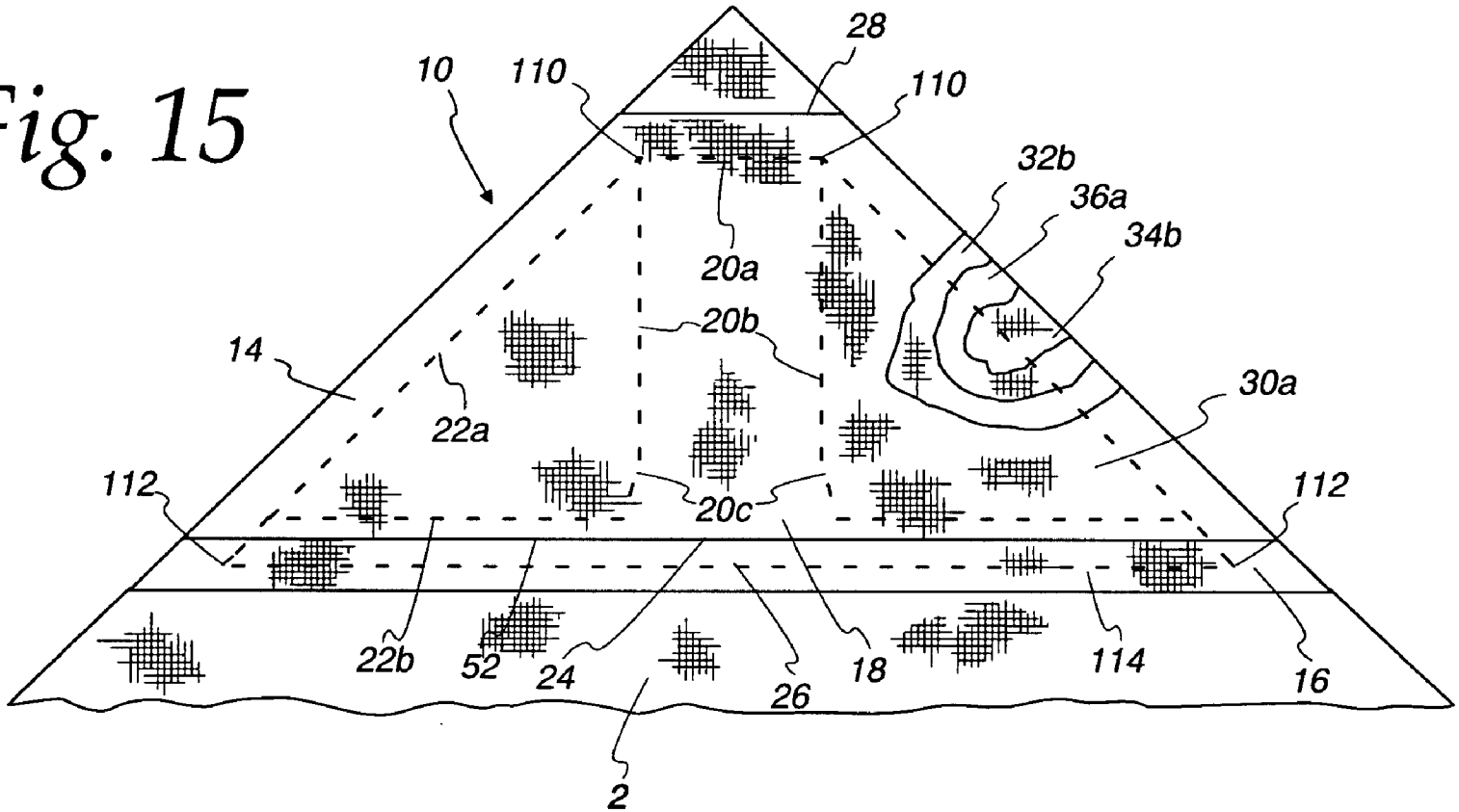
FIG. 15 shows the rib-engaging support of FIGS. 1-14 applied to a sign panel.

Turning now to FIG. 15, the rib-engaging support 10 is shown secured to a flexible sign panel 2. With reference to FIG. 15, reference number 110 is applied to the intersection of stitching lines 20*a*, 20*b* and 22*a*. Two intersections are shown in FIG. 15, one at each end of stitching line 20*a*. Several additional (perimeter-attaching) lines of stitching secure the rib-engaging support 10 to the message panel. One line of stitching begins at point 110 and extends along the stitching line 22*a*, to a point identified by reference number 112 located in threshold 26. A second line of perimeter-attaching stitching extends between the remaining pair of reference points 110, 112 at the opposite side of the rib-engaging support. A third line of stitching indicated by reference number 114 extends between reference points 112 to secure the threshold 26 of the rib-engaging support to the flexible sign panel 2. The perimeter attachment of rib-engaging support 10 to the flexible sign panel may also include a line of stitching at stitching line 20*a*, although this relatively short amount of stitching can be omitted, if desired. In certain instances, it may be desirable to avoid overlapping one line of stitching on top of another, as described for the perimeter attaching. Accordingly, the perimeter lines of stitching joining the rib-engaging support 10 to the flexible sign panel may be moved to one side of stitching lines 20*a*, 22*a*. As a further alternative, lines of stitching shown in a second alternative embodiment of FIG. 16-18 may be employed.

Figure 16:
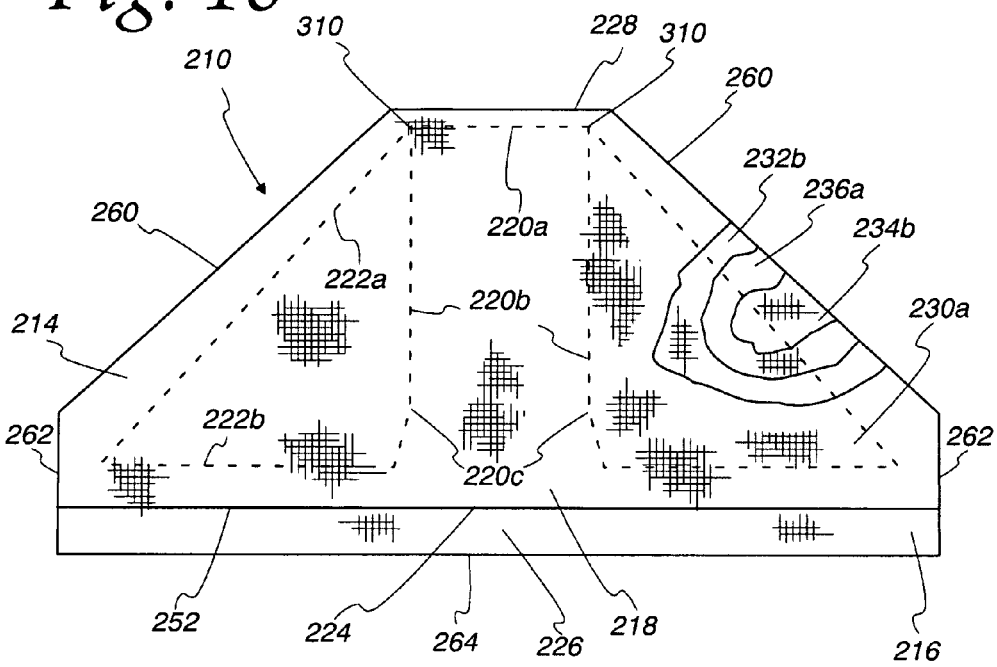
FIG. 16 is a schematic elevational view of an alternative rib-engaging support.
Figure 18:
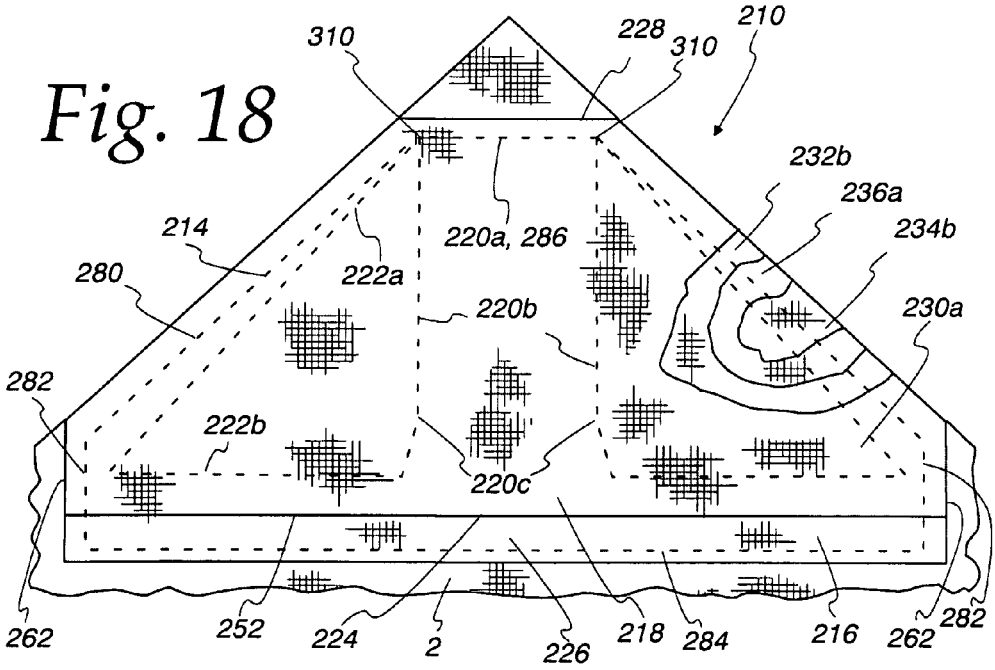
FIG. 18 is a schematic elevational view of the rib-engaging support of FIG. 16 shown attached to a sign panel.
Figure 17:
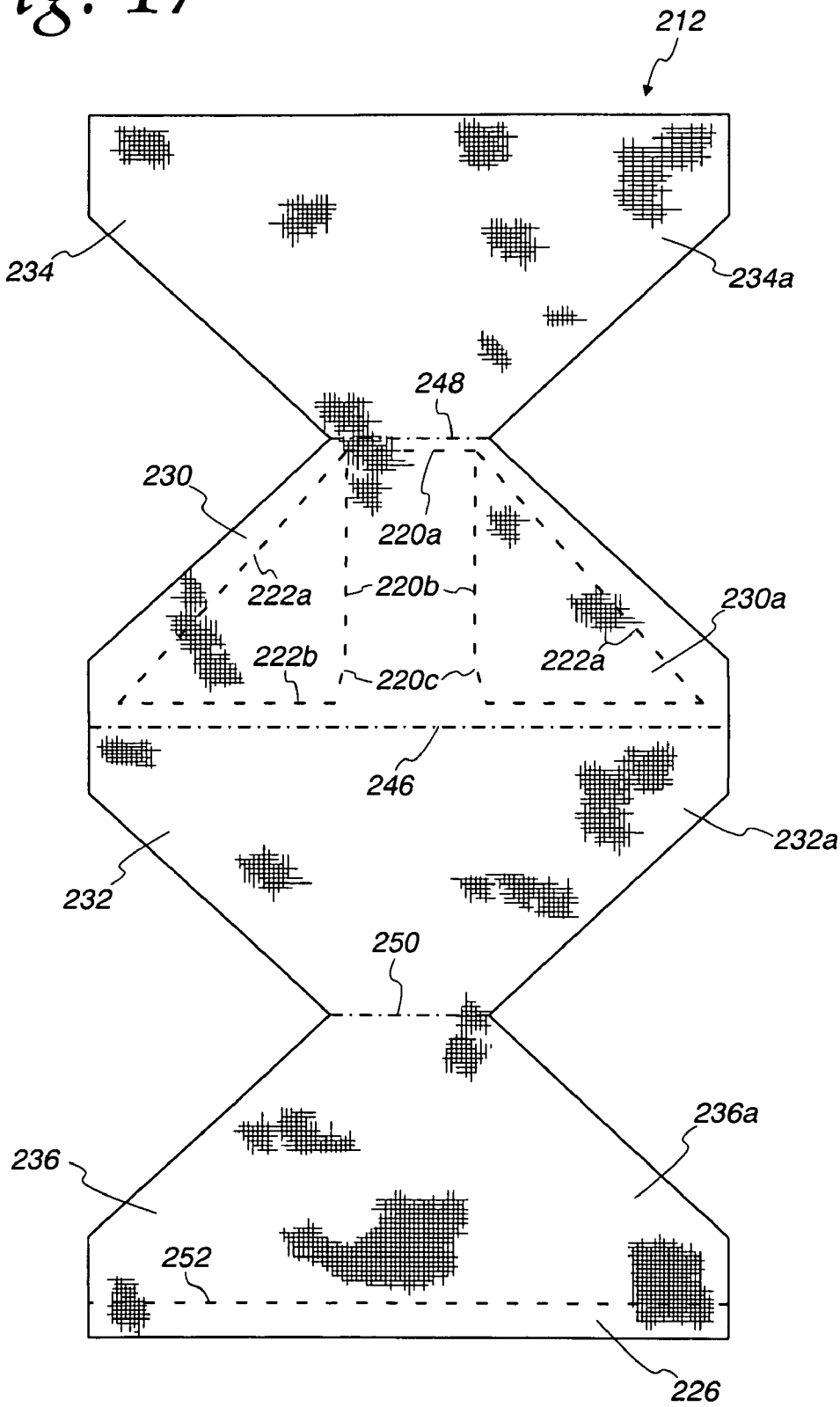
FIG. 17 is a schematic plan view of a web from which the rib-engaging support of FIG. 16 is constructed.

Turning now to FIGS. 16-18, a second alternative embodiment of a rib-engaging support is generally indicated at 210. As can be seen by comparing FIGS. 1 and 16, many features are shared between the two embodiments of rib-engaging supports identified at 10, 210. Rib-engaging support 210 of the second embodiment is preferably formed from a one-piece continuous integral blank 212 shown in FIG. 17. By comparing the blank 212 of FIG. 17 to the blank 12 of FIG. 4 it can be seen that the blanks are similar, except in blank 212, the sharp corners at the tips of the triangular ends of the panels 230-236 have been truncated. Preferably, stitching in the second embodiment of the rib-engaging support, joining the four panels together is essentially identical to the stitching described above with reference to the first embodiment 10 of the rib-engaging support according to principles of the present invention. Preferably, the lateral edges 260 of the rib-engaging support are not parallel to stitching lines 222*a*, but rather are displaced therefrom by a relatively small acute angle. Further, the lower portions of edges 260 are truncated by relatively short vertical edges 262. As in the first embodiment, the rib-engaging support 210 has a bottom edge 264 that is generally parallel to the upper edge 228.

For purposes of comparison of the rib-engaging supports 10, 210 a hypothetical situation can be envisioned where stitching lines 20*a*-20*c*, 22*a* and 22*b* of FIG. 1 are identical to stitching lines 220*a*-220*c*, 222*a* and 222*b* of FIG. 16. In this hypothetical comparison, the rib-engaging support 210 has additional material lying outboard of the point where stitching lines 222*a*, 222*b* meet. However, because rib-engaging support 210 omits the triangular tips present in rib-engaging support 10, the material from which blank 212 is formed may be no wider and may even be narrower than the width of the material from which blank 12 of the first embodiment 10 is formed. Thus, as highlighted by this hypothetical comparison, it can be seen that the efficiency of the design and construction of the rib-engaging support 210 is improved in certain respects.

Referring now to FIG. 17, blank 212 is comprised of a serial succession of four panels 234, 230, 232 and 236. Number 252 in FIG. 17 is applied to a reference line showing the point of overlap when the panel is folded in the manner indicated in FIGS. 16 and 18. Number 226 is applied to an exposed portion of panel 236 which allows an improved insertion of the rib member into pocket 218 (see FIG. 16). The entrance of pocket 218 is indicated by reference number 224 in FIG. 16.

The four panels of blank 212 are joined by fold lines 248, 246 and 250. In the manner indicated above with respect to the first embodiment 10, fold lines 248, 250 overly one another when assembled in the manner indicated for example in FIG. 16, and fold line 246 appears at the free edge 252 shown in FIG. 16. The panels 230-236 have opposed major surfaces indicated by a suffix "a" for the top side visible for example in FIG. 17 and an opposed bottom side indicated by the suffix "b." Examples of the major surfaces are indicated in the right hand portions of FIGS. 16 and 18.

Referring now to FIG. 18, rib-engaging support 210 is shown secured to a flexible message panel 2 by stitching lines 280, 282, 284 and 286 (which overlies stitching 220*a*). For comparison purposes, the bottom stitching line 284 shown in FIG. 18 is substantially similar in location to the bottom stitching line 114 shown in FIG. 15. Preferably, stitching lines 280, 282 and 284 are located inboard of edges 260, 262 and 264. Stitching lines 280, 222*a* originate at the same point 310, with the stitching lines 280, 222*a* being angularly offset from one another, preferably by a relatively small acute angle less than 45°, and most preferably less than 20°. Employment of an acute angle displacement between stitching lines 280, 222*a* has been found to substantially alleviate or eliminate puckering of the sewn layers of panels 230-236 in the region of stitching line 222*a* and particularly the lower portion thereof. Preferably, the points of intersection of stitching lines 222*a*, 222*b* are spaced from the closest adjacent peripheral stitching line 282. Although not required, it is generally preferred that the stitching lines 280 securing the support to the flexible message panel are generally parallel to the closest edge of the message panel, while the inner stitching line 222*a* is offset at an acute angle to the closest edge of the message panel as well as the adjacent stitching line 280.

The arrangement of stitching lines described for rib-engaging support 210 provide a number of advantages, including an efficient distribution of forces applied to the rib-engaging support by a rib member, including a rib member which is slightly too long for the size of the flexible sign panel employed. In this latter instance, the rib member will be retained in a somewhat bowed configuration when fully installed with the flexible sign panel and allowed to come to rest. In this instance, the rib member received in pocket 218 applies an upward force to the rib-receiving pocket which tends to pull apart the overlying layers of fabric panels disposed on either side of the rib. In this instance, separating force applied by the rib will be applied along stitching lines 220*b*. Angle stitching lines 220*c* provide an additional advantage in smoothly distributing the displacing force throughout the rib-engaging support, since lines 220*c* form an angle with stitching lines 220*b* that is substantially greater than 90°. The relative position of stitching lines 280, 222*a*, taken with other features of the rib-engaging support provides an improved distribution of the force applied by the rib throughout the remainder of the rib-engaging support.

While rib-engaging support 10 and 21 are shown configured for use as a corner bracket in a square or diamond-shaped sign panel (see FIG. 14, for example), it will be readily appreciated that the rib-engaging support can be readily adapted to assume other shapes as may be desired. For example, if the rib-engaging support is required at the corner of a sign panel having an angular size other than 90°, the congruent angles of the various isosceles trapezoid panels of FIGS. 4 and 17 can be adjusted to accommodate the alternative sign panel shape.

The rib-engaging support shown and described herein is preferably made from fabric material. Preferably, the fabric material of the rib-engaging support is different from the material of the sign panel, which is typically optimized for other purposes, such as adequate reflectivity mandated by federal performance standards. Accordingly, the material of rib-engaging support 10 can be optimized for strength and wear resistance and is not constrained by the choice of material or construction of the sign panel.

Although flexible sign panels have been described herein, it will be readily appreciated that the rib-engaging support provided by the present invention may be employed with rigid sign panels which are supported or are otherwise secured or attached to rib members. Also, packaging arrangements may benefit from the rib-engaging support of the present invention, as where elongated rib members are provided in association with an elongated package, to prevent the package from becoming bent or folded in transit.

While it is generally desirable to receive a support rib in the rib-engaging support with a removable "dry fit," the rib end may be coated with a suitable adhesive before insertion in the rib-engaging pocket, to later prevent its unintentional withdrawal and so as to form a permanent connection.

In the examples above, each rib-engaging support receives a single rib. However, the present invention also contemplates rib-engaging supports in which multiple pockets are formed, preferably side-by-side and extending at different angles. If desired, additional layers can be stacked on top of or below the rib-engaging support for the purpose of adding more pockets to the rib-engaging support.

The foregoing description and the accompanying drawings are illustrative of the present invention. Still other variations and arrangements of parts are possible without departing from the spirit and scope of this invention.

What is claimed is:

1. A rib-engaging support made from a unitary web, comprising:

a serial succession of four panels, including two inner panels and two outer panels, each panel having the shape of a isosceles trapezoid, with a base side and a top side parallel to each other, and with a pair of equal sides extending between the base side and the top side;

the inner panels having the same, first size and joined together at their bases;

the outer panels having a second size larger than the first size, the top sides of the outer panels joined to the top sides of respective inner panels;

the web folded such that the inner panels are folded one on top of the other and the outer panels are folded one on top of the other, with the inner panels on top of the outer panels; and a rib-receiving pocket formed between the inner panels and the outer panels.

2. The rib-engaging support of claim 1 wherein the outer panels form congruent angles between their equal sides and the base side, and the inner panels form the same angles between their equal sides and the base side.

3. The rib-engaging support of claim 1 wherein the outer panels extend beyond the inner panels, forming a lip.

4. The rib-engaging support of claim 3 wherein the lip is disposed directly underneath the rib receiving pocket.

5. The rib-engaging support of claim 4 wherein the rib receiving pocket has a flared opening.

6. The rib-engaging support of claim 1 further comprising connecting structure for connecting the rib pocket to a sign panel.

7. The rib-engaging support of claim 6 wherein the connecting structure comprises marginal edge portions of the inner and the outer panels.

8. The rib-engaging support of claim 1 wherein the rib receiving pocket is closed at one end by stitching located immediately adjacent to a folded connection of the inner panels and a folded connection of the outer panels.

9. The rib-engaging support of claim 8 wherein the folded connection of the inner panels is nested within the folded connection of the outer panels.

10. The rib-engaging support of claim 1 further comprising marginal edges of the panels for connecting the rib-receiving pocket to a sign panel.

11. The rib-engaging support of claim 10 wherein the outer panels are disposed between the rib-receiving pocket and the sign panel.

12. The rib-engaging support of claim 1 wherein the web includes a pair of fold lines, one at each joinder of an inner panel to an outer panel.

13. A flexible warning sign comprising:

a flexible message panel for displaying a message;

a rib-engaging support associated with the flexible message panel, made from a unitary web, comprising a serial succession of four panels, including two inner panels and two outer panels;

each panel having the shape of a isosceles trapezoid, with a base side and a top side parallel to each other, and with a pair of equal sides extending between the base side and the top side;

the inner panels having the same, first size and joined together at their bases;

the outer panels having a second size larger than the first size, the top sides of the outer panels joined to the top sides of respective inner panels;

the web folded such that the inner panels are folded one on top of the other and the outer panels are folded one on top of the other, with the inner panels on top of the outer panels;

a pocket formed between the inner panels and the outer panels for receiving an end of the support rib; and at least one support rib received in the pocket.

14. The flexible warning sign of claim 13 wherein the support rib is removably received in the pocket.

15. The flexible warning sign of claim 13 wherein the outer panels extend beyond the inner panels, forming a lip.

16. The flexible warning sign of claim 15 wherein the lip is disposed directly underneath the rib receiving pocket.

17. The flexible warning sign of claim 13 wherein the rib receiving pocket has a flared opening.

18. The flexible warning sign of claim 13 wherein the rib receiving pocket is closed at one end by stitching located immediately adjacent to a folded connection of the inner panels and a folded connection of the outer panels.

19. The flexible warning sign of claim 13 wherein the rib-engaging support is secured to the flexible message panel by stitching.

20. The flexible warning sign of claim 13 wherein the rib-engaging support includes marginal edge portions of the inner and the outer panels for securement to the flexible message panel.

21. The flexible warning sign of claim 20 wherein the rib-engaging support is secured to the flexible message panel by stitching associated with the marginal edge portions.

22. A flexible warning sign comprising:

a flexible message panel for displaying a message and having a plurality of corners;

a rib-engaging support secured to at least one of the corners of the flexible message panel, made from a unitary web, comprising a serial succession of four panels, including two inner panels and two outer panels;

each panel having the shape of an isosceles trapezoid, with a base side and a top side parallel to each other, and with a pair of equal sides extending between the base side and the top side;

the inner panels having the same, first size and joined together at their bases;

the outer panels having a second size larger than the first size, the top sides of the outer panels joined to the top sides of respective inner panels;

the web folded such that the inner panels are folded one on top of the other and the outer panels are folded one on top of the other, with the inner panels on top of the outer panels;

a pocket formed between the inner panels and the outer panels for receiving an end of the support rib; and at least one support rib received in the pocket.

23. The flexible warning sign of claim 22 wherein the flexible message panel has a pair of opposed corners, with a rib-engaging support at each corner and with the support rib extending between the rib-engaging supports.

24. The flexible warning sign of claim 23 wherein the outer panels extend beyond the inner panels, forming a lip disposed an opening of the rib receiving pocket.

25. The flexible warning sign of claim 22 wherein the rib-engaging supports are secured to the flexible message panel by stitching.

* * * * *

UNITED STATES PATENT AND TRADEMARK OFFICE

CERTIFICATE OF CORRECTION

PATENT NO. : 8,122,630 B2
APPLICATION NO. : 12/459496
DATED : February 28, 2012
INVENTOR(S) : Grant D. Dicke It is certified that error appears in the above-identified patent and that said Letters Patent is hereby corrected as shown below:

Column 2, line 16, "engaging support is made from a unitary web" should read --engaging support made from a unitary web--

Column 3, line 41, "sign assembly I" should read --sign assembly 1--

Column 4, line 5, "sign assembly I" should read --sign assembly 1--

Column 5, line 27, "tip I" should read --tip T--

Column 5, line 29, "referred to an isosceles trapezoid" should read --referred to as an isosceles trapezoid--

Column 5, line 31, "top Z." should read --top Z,--

Column 8, line 57, "overly one another when assembled" should read --overlie one another when assembled--

Column 12, line 36 (Claim 24) "forming a lip disposed an opening" should read --forming a lip disposed at an opening--

Signed and Sealed this
Twelfth Day of June, 2012

David J. Kappos

David J. Kappos
*Director of the United States Patent and Trademark Office*